US007922527B2

(12) United States Patent
Xu et al.

(10) Patent No.: US 7,922,527 B2
(45) Date of Patent: Apr. 12, 2011

(54) CABLE ASSEMBLY WITH LOCKING MEMBER

(75) Inventors: Bin Xu, Kunshan (CN); Su-Feng Liu, Kunshan (CN); Chin-Te Lai, Tu-Cheng (TW); Li-Bin Wang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/509,620

(22) Filed: Jul. 27, 2009

(65) Prior Publication Data

US 2010/0022116 A1 Jan. 28, 2010

(30) Foreign Application Priority Data

Jul. 26, 2008 (CN) ..... 2008 2 0042115

(51) Int. Cl.
*H01R 13/73* (2006.01)

(52) U.S. Cl. ..... 439/557

(58) Field of Classification Search ..... 439/552–557
See application file for complete search history.

(56) References Cited

U.S. PATENT DOCUMENTS 4,664,458 A * 5/1987 Worth ..... 439/82
4,988,308 A * 1/1991 Toedtman ..... 439/248
6,830,483 B1 * 12/2004 Wu ..... 439/638
6,896,556 B1 5/2005 Hai

* cited by examiner

*Primary Examiner* — Ross N Gushi
(74) *Attorney, Agent, or Firm* — Wei Te Chung; Andrew C. Cheng; Ming Chieh Chang

(57) ABSTRACT

A cable assembly (100) is mounted into a panel (200) defining a mounting hole (501) and has a first connector (1), a second connector (2) back to back assembled to the first connector, and a cable device (3) mounted to the first connector. The first connector (1) has a first insulative housing (10) having a base (101) and at least a locking member (102) extending through the mounting hole to lock the first connector to the panel. The base and the locking member are integrally formed as a whole.

15 Claims, 4 Drawing Sheets

CABLE ASSEMBLY WITH LOCKING MEMBER

BACKGROUND OF THE INVENTION

1. Field of the Invention

The present invention relates to a cable assembly, and particularly to a cable assembly having a locking member to lock the cable assembly to a panel.

2. Description of Related Art

In recent days, an electrical connector known as a Serial Advanced Technology Attachment (Serial ATA) connector, according to the newly developed Serial ATA interface standard, is developed to be generally used for connecting storage peripheral devices such as hard disk drives with a mother printed circuit board so as to achieve signal or power transmission therebetween.

U.S. Pat. No. 6,896,556 issued to Wu discloses a cable assembly to a Serial ATA connector mounting into a panel and comprising a first connector having a first insulative housing, a second connector mounted to the first insultive housing and a cable device assembled to the first insultive housing. The panel has a mounting hole defined therethrough. The cable assembly is mounted to panel by a plurality of nuts riveting through the first insulative housing of the first connector and screwing into the mounting hole of the panel.

However, it will result in a complex process and a high manufacture cost during assembly of the cable assembly to the panel.

Hence, it is desirable to provide an improved cable assembly to overcome the aforementioned disadvantages.

SUMMARY OF THE INVENTION

Accordingly, an object of the present invention is to provide a cable assembly having a locking member to easily lock the cable assembly to a panel.

In order to achieve the object set forth, a cable assembly is mounted into a panel defining a mounting hole and comprises a first connector, a second connector back to back assembled to the first connector, and a cable device mounted to the first connector. The first connector comprises a first insulative housing having a base and at least a locking member extending through the mounting hole to lock the first connector to the panel. The base and the locking member are integrally formed as a whole.

Advantages of the present invention are to provide a first connector having a locking member extending from the base and riveting into a mounting hole of the panel. The locking member and the base are integrally formed as a whole to assemble the cable assembly to the panel. Therefore, it is easy to assemble the cable assembly to the panel by the engagement between the locking member and the panel.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
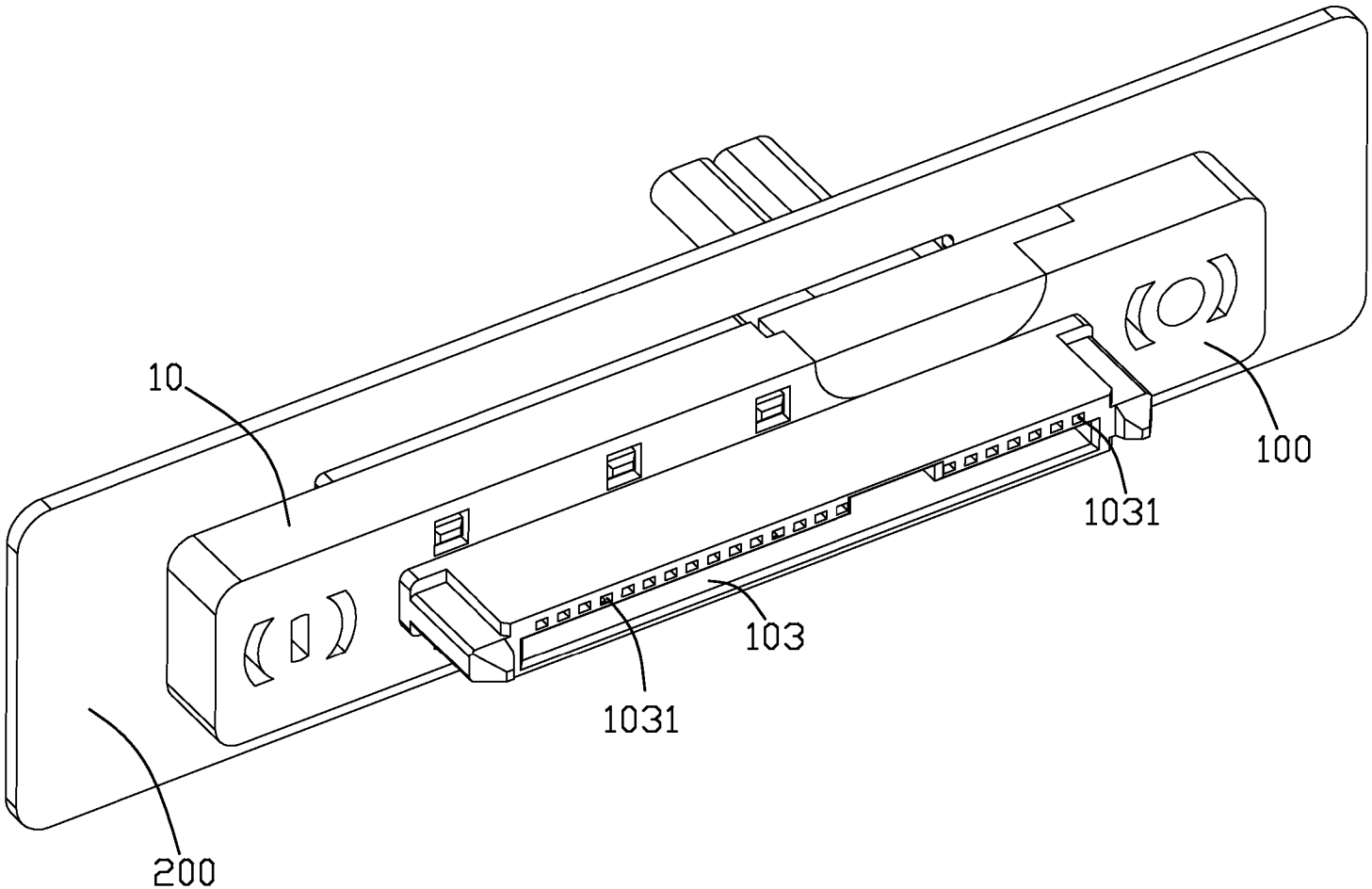
FIG. 1 is a perspective view of a cable assembly in accordance with the present invention, the cable assembly is mounted to a panel.
Figure 2:
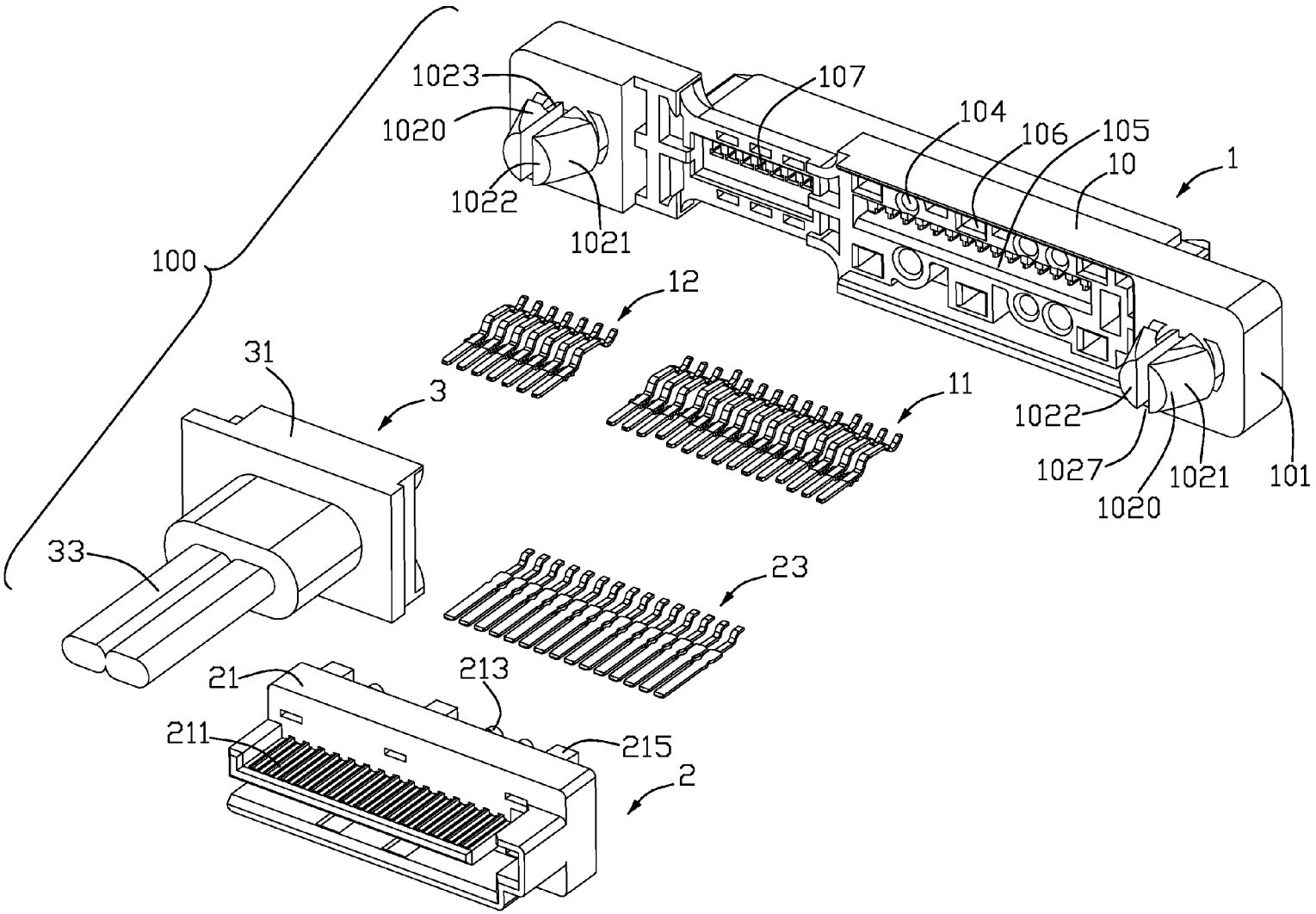
FIG. 2 is an exploded view of the cable assembly as shown in FIG. 1.
Figure 3:
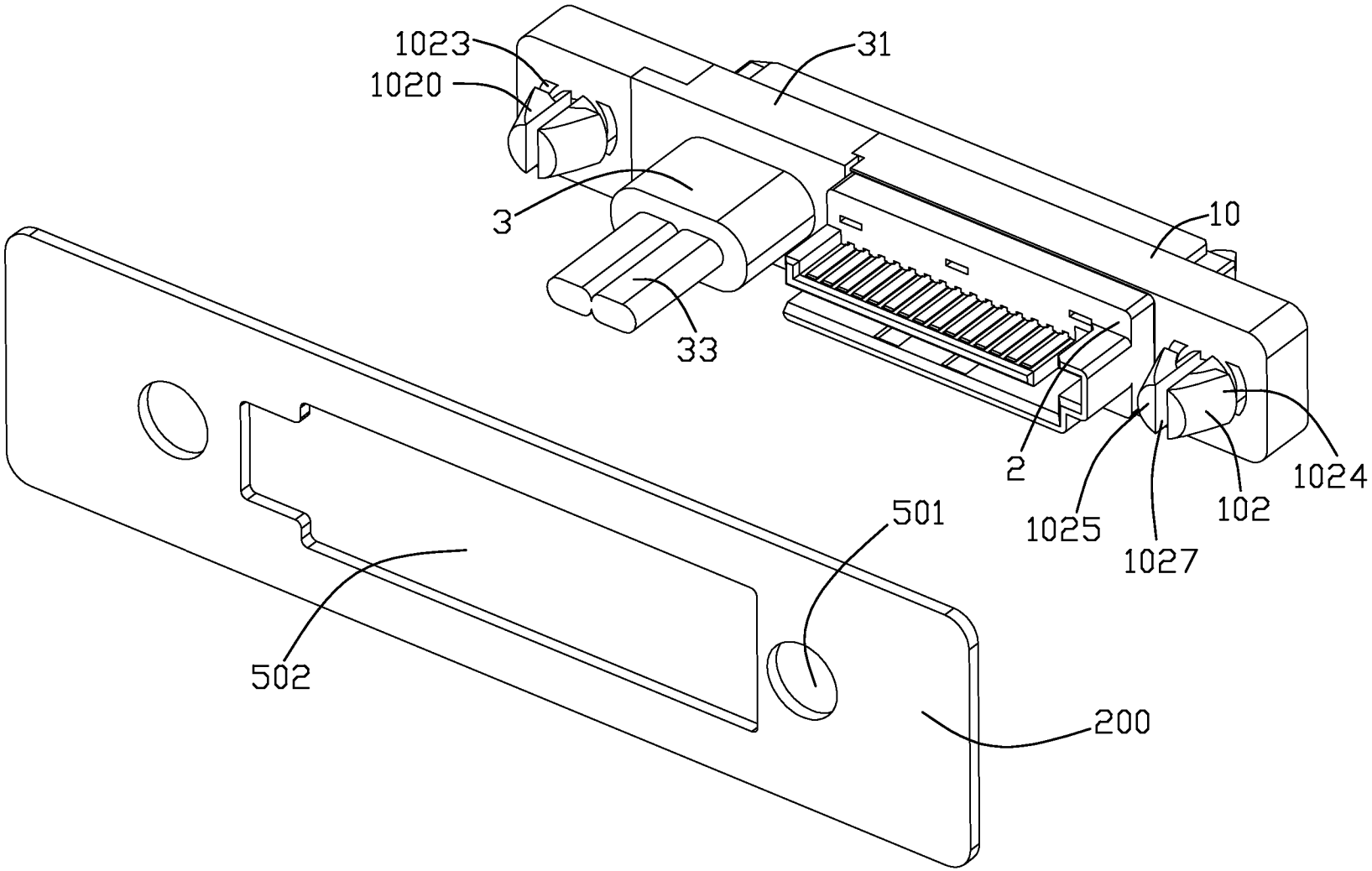
FIG. 3 is a perspective view of the cable assembly and the panel as shown in FIG. 1.

Referring to FIGS. 1, 2 and 3, a cable assembly 100 mounted to a panel 200 in accordance with the present invention comprises a first connector 1, a second connector 2 back to back assembled to the first connector 1, a cable 3 terminated to the first connector 1. In a preferred embodiment, the first connector 1 is a Serial Advanced Technology Attachment (Serial ATA) receptacle connector. The second connector 2 is a Serial ATA plug connector. The cable 3 is a Serial ATA cable. The panel 200 has a cutout 502 for mating with the cable assembly 100 and a pair of mounting holes 501 therethrough.

The first connector 1 comprises a first insulative housing 10 and a plurality of first and second receptacle contacts 11, 12 retained in the first housing 10. The first housing 10 has an elongate base 101 and a pair of locking members 102 extending rearwardly from a back face of the base 101. The locking member 102 protrudes from opposites side portions of the base 101 and extends through the mounting hole 501 for locking the first connector 1 to the panel 200. The base 101 and the locking member 102 are integrally formed as a whole. The locking member 102 extends in a rearward direction and comprises a slit 1027 directed in the rearward direction to separate the locking member 102 into a first flexible finger 1024 and a second flexible finger 1025. The locking member 102 has a threaded section 1020 exposed to an exterior of the panel 200, and an interconnecting section 1023 connecting the threaded section 1020 to the base 101 of the first insulative housing 10 and retained in the mounted hole 501 of the panel 200. The diameter of the interconnecting section 1023 is smaller than a diameter of threaded section 1020. The threaded section 1020 is of V shape and has a tip portion 1021 and an end portion 1022 having a diameter smaller than a diameter of the tip portion 1021. The tip portion 1021 abuts against the front face of the panel 200.

The first connector 1 has a mating tongue 103 extending perpendicularly and forwardly from a front face of the base 101 for mating with a plug connector (not shown) and defines a plurality of slots 1031. The first insulative housing 10 has a plurality of first passageways 105 communicating with the slots 1031 of the mating tongue 103 and a plurality of second passageways 107 communicating with the slots 1031. The first and the second receptacle contacts 11, 12 are assembled into the first and the second passageways 105, 107, respectively.

The second connector 2 comprises a second insulative housing 21 and a plurality of plug power terminals 23 retained in the second insulative housing 21 for electrically connecting with the first receptacle contacts 11. The second insulative housing 20 includes a tongue portion 211 extending rearwardly from a middle portion thereof for mating with a complementary second connector (not shown).

The cable connector 3 comprises a third insulative housing 31 and a pair of wires 30 retained in the third insulating housing 31 and contacting with the second receptacle contacts 12 of the first connector 1.

Figure 4:
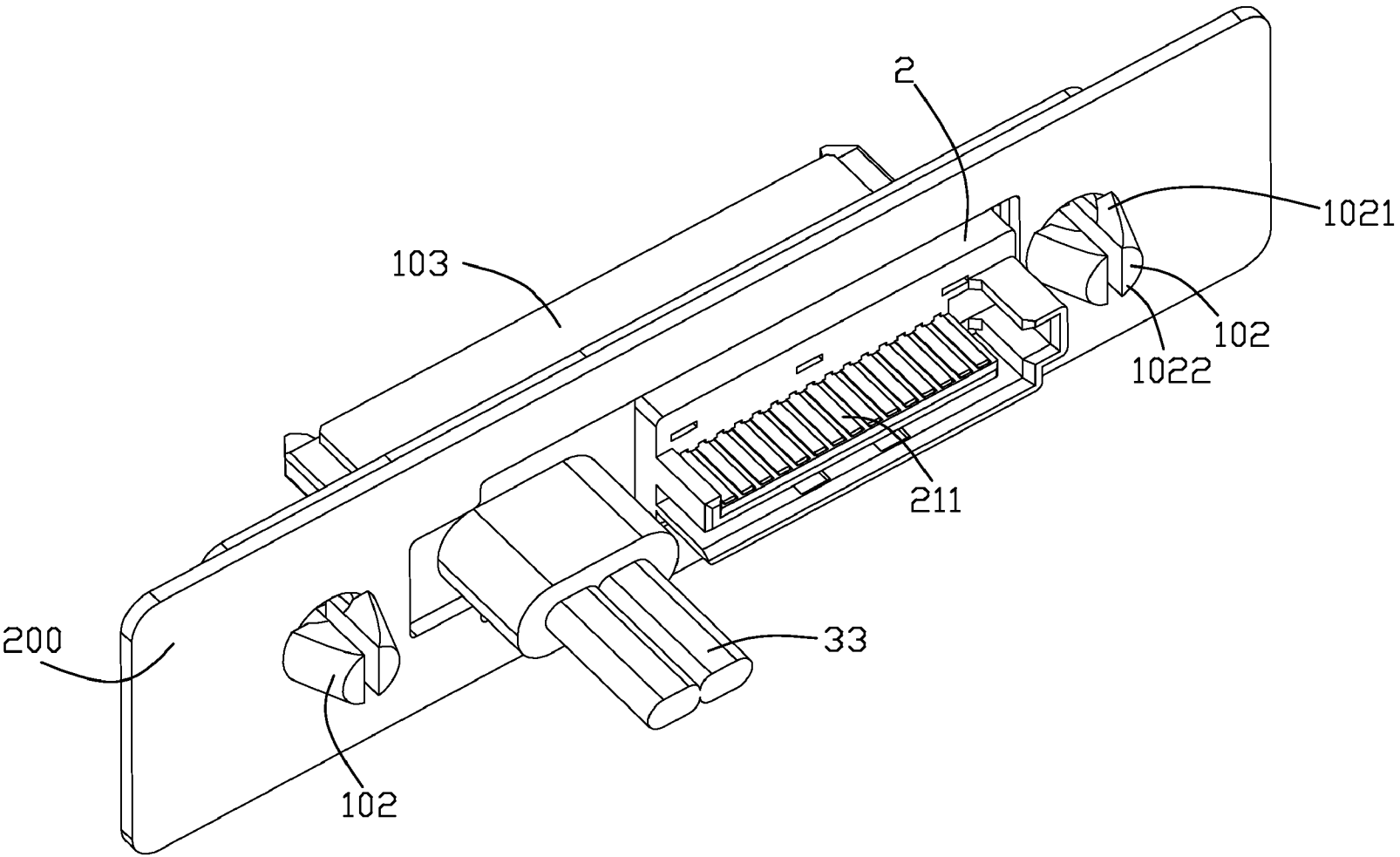
FIG. 4 is an assembled, perspective view of the cable assembly and the panel as shown in FIG. 2, taken from another aspect.

Referring to FIGS. 2-4, the second connector 2 is back to back assembled to the first connector 1 with a plurality of posts 213 and 215 received in the holes 104 and 106 of the first housing 10.

It can be understood that the cable assembly 100 is mounted into the cutout 502 by the engagement between the locking member 102 and the panel 200. The locking member 102 and the base 101 are integrally formed as a whole to assemble the cable assembly 100 to the panel 200. Therefore, it is easy to assemble the cable assembly 100 to the panel 200.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly for mounting to a panel, comprising:

a first connector comprising a first insulative housing having a base and at least one locking member extending through and locking to the panel, said base and the locking member being integrally formed;

a second connector back to back assembled to the first connector; and a cable device mounted to the first connector;

wherein said locking member has a threaded section exposed to an exterior of the panel, and an interconnecting section connecting the threaded section to the base of the first insulative housing and retained in a mounting hole of the panel, and wherein a diameter of the interconnecting section is smaller than a diameter of threaded section.

2. The cable assembly as claimed in claim 1, wherein said locking member extends in a rearward direction and comprises a slit directed in the rearward direction to separate the locking member into a first flexible finger and a second flexible finger.

3. The cable assembly as claimed in claim 1, wherein said threaded section is of V shape and has a tip portion and an end portion, the end portion having a diameter smaller than a diameter of the tip portion, the tip portion abutting against a front face of the panel.

4. The cable assembly as claimed in claim 1, wherein said first insulative housing has two locking members disposed at opposite side portions thereof, the second connector and the cable device being mounted between the two locking members.

5. The cable assembly as claimed in claim 1, wherein said insulative housing has a mating tongue protruding forwardly from the base for mating with a plug connector.

6. The cable assembly as claimed in claim 5, wherein said first connector has a plurality of contacts mounted into the base and extending into the mating tongue.

7. The cable assembly as claimed in claim 6, wherein said second connector has a plurality of first terminals contacting with the contacts of the first connector, and wherein the cable device has a plurality of cables electrically connected to the contacts of the first connector.

8. The cable assembly as claimed in claim 1, wherein the first connector is a Serial Advanced Technology Attachment (Serial ATA) receptacle connector, the second connector is a Serial ATA plug connector, and the cable is a Serial ATA cable.

9. A connector assembly comprising:

a first insulative housing defining opposite first outward and inward surfaces, a first mating port extending forwardly on said outward surface;

a second insulative housing defining opposite second outward and inward surfaces, a second mating port extending rearwardly on said second outward surface, said second housing back to back assembled with the first housing under condition that the first inward surface faces the second housing and the second inward surface faces the first housing;

at least one set of contacts disposed along a front-to-back direction and extending through both said first housing and said second housing with opposite first and second contacting sections exposed in the corresponding first mating port and the second mating port, respectively;

a pair of panel locks unitarily extending rearwardly from the first inward surface; and a metal flat panel defining a large center opening and a pair of through holes by two opposite ends of the center opening and defining opposite outward and inward faces thereof under condition; wherein the second mating port extends rearwardly through the center opening, and the pair of panel locks rearwardly extend respectively through the corresponding through holes and further latchably respectively engage the outward face of the panel for locking the first housing and the panel together;

a cable extending rearwardly from the first housing beside the second housing and further through said center opening;

wherein said cable is retained in a third insulative housing which is assembled to the first housing, and a periphery of said third housing is sandwiched between the first housing and the metal panel for retention.

10. The connector assembly as claimed in claim 9, wherein another set of contacts extend in both the first housing and the third housing and connected to corresponding conductors in the cable.

11. The connector assembly as claimed in claim 9, wherein said panel lock is resilient and is detachable with regard to the panel.

12. The connector assembly as claimed in claim 9, wherein each of said panel locks is equipped with a pair of locking sections to engage the outward face of the metal panel, and a pair of through apertures are formed in the first housing intimately located around each of said panel locks and in alignment with said pair of locking sections along a front-to-back direction for consideration of injection molding of said panel lock unitary with the first housing.

13. The connector assembly as claimed in claim 9, wherein the at least one set of contacts includes a first receptacle contact and a plug power terminal electrically connects with each other.

14. The connector assembly as claimed in claim 9, wherein there is a plurality of the at least one set of contacts disposed along a transversal direction.

15. An electrical connector assembly comprising:

a first insulative housing defining a forward mating port;

a second insulative housing assembled to the first housing and defining a rearward mating port;

a cable assembly extending rearwardly from the first housing;

at least one panel lock unitarily extending from the first housing;

a metallic panel located on a rear side of the first housing and defining a center opening through which the second port extend rearwardly and a through hole beside the center opening, through which the panel lock is latched to the panel;

wherein said panel lock is resilient so as to be releasable with regard to the metal panel;

wherein said panel lock defines a latching section abutting against a face of the panel around the through hole, and said first housing further defines a through aperture around the panel lock and in alignment with said latching section in a front-to-back direction for consideration of injection molding of said panel lock unitary with the first housing.

* * * * *